US005311807A

United States Patent [19]

Rüttgerodt

[11] Patent Number: 5,311,807

[45] Date of Patent: May 17, 1994

[54] MILITARY TANK

[75] Inventor: Gottlieb Rüttgerodt, Baunatal, Fed. Rep. of Germany

[73] Assignee: Firma Wegmann & Co. GmbH, Kassel, Fed. Rep. of Germany

[21] Appl. No.: 943,668

[22] Filed: Sep. 11, 1992

[30] Foreign Application Priority Data

Oct. 12, 1991 [DE] Fed. Rep. of Germany ..... 4133797

[51] Int. Cl.[5] ..... F41H 7/02

[52] U.S. Cl. ..... 89/36.08; 89/36.13; 89/46

[58] Field of Search ..... 89/36.08, 36.13, 40.03, 89/46; D12/12

[56] References Cited

U.S. PATENT DOCUMENTS

| | | | |
|---|---|---|---|
| D. 252,453 | 7/1979 | Appelblatt et al. | D12/12 |
| D. 315,535 | 3/1991 | Lockhart | D12/12 |
| 2,712,271 | 7/1955 | Wabnitz | 89/36.13 |
| 3,269,269 | 8/1966 | Kunze | 89/36.08 |
| 4,064,787 | 12/1977 | Eklund et al. | 89/36.08 |
| 4,329,909 | 5/1982 | Tidstrom | 89/46 |
| 4,429,616 | 2/1984 | Grosser | 89/36.13 |

FOREIGN PATENT DOCUMENTS

| | | | |
|---|---|---|---|
| 570615 | 10/1961 | Belgium | 89/36.08 |
| 2324989 | 3/1981 | Fed. Rep. of Germany | 89/36.08 |
| 3132215 | 3/1983 | Fed. Rep. of Germany | 89/36.13 |
| 3642920 | 6/1988 | Fed. Rep. of Germany . | |
| 2552470 | 3/1989 | Fed. Rep. of Germany . | |
| 1160125 | 7/1958 | France | 89/36.08 |
| 1261156 | 4/1961 | France | 89/36.08 |
| 2511495 | 2/1983 | France | 89/36.08 |

OTHER PUBLICATIONS

Technology Update, Military, "Coming: Our Fast New Battle Armor", Popular Mechanics, Feb. 1984, pp. 68-69.

Nick Nichols, "Tanks for Tomorrow", Popular Mechanics, May 1988, pp. 68-71.

*Primary Examiner*—Stephen C. Bentley

*Attorney, Agent, or Firm*—Sprung Horn Kramer & Woods

[57] ABSTRACT

A military tank with a heavy weapon suspended to pivot in elevation in a turret that rotates on a chassis. The turret (2) is on the rear half (1.2) of the chassis (1) and its drive mechanisms are in the forward half. At least the section of the upper surface (1.2) below the turret slopes back and down at a prescribed angle ($\alpha$) to the horizontal. The vertical longitudinal cross-section (LM) of the turret is a wedge that tapers together forward with its bottom (2.1) paralleling the upper surface of the chassis and its top (2.2) at another prescribed angle ($\beta$) to the horizontal.

11 Claims, 3 Drawing Sheets

MILITARY TANK

BACKGROUND OF THE INVENTION

The invention concerns a military tank with a heavy weapon suspended to pivot in elevation in a turret that rotates on a chassis.

The turret in known military tanks usually rotates around a vertical axis through the center of the chassis. The turret is often shaped like a squat parallelipiped, sometimes with beveled corners and sloping walls. The weapon is usually secured to the turret with at least the end behind the trunnions extending inside.

Also known (from German OS 3 642 920) are what are called armored howitzers. The turret that accommodates the heavy weapon in an armored howitzer is behind the center of the chassis and the drive mechanisms are forward.

SUMMARY OF THE INVENTION

The object of the present invention is a military tank of the aforesaid type that is not only particularly light in weight but will also extensively protect the crew.

This object is attained in accordance with the invention in that the turret is on the rear half of the chassis behind a transverse line through the center, the drive mechanisms are accommodated in the chassis in front of said transverse midline, and the surface of at least the section of the chassis under the turret slopes to the rear at a prescribed acute angle to the horizontal, whereas the vertical longitudinal cross-section of the turret is a wedge that tapers acutely together from back to front with its lower edge paralleling the upper surface of the chassis and its upper surface at another prescribed acute angle to the horizontal. Advantageous embodiments of the tank in accordance with the invention are described later herein.

The basic concept of the invention is to exploit the novel turret to obtain certain characteristics in a tank that have previously been possible only in an armored howitzer. Mounting a wedge-shaped turret on the rear of a chassis that slopes down to the rear will, due to the turret's very small silhouette, better protect the front and sides. Furthermore, utilizing the front half of the chassis will protect the front even better, making it possible to reduce armor and accordingly weight.

The angle of the wedge is the sum of the angle between the upper surface of the downward-and-backward sloping chassis and the horizontal and the angle between the top of the turret and the horizontal. The particular angles employed will afford approximately equal protection to both the front and the top of the turret with relatively thin roofing armor. It must be kept in mind that the angle of the turret's wedge shape should not be too obtuse, so that the top of the turret will not slope up too steeply and the upper surface of the chassis will not slope down too rapidly. The former situation would enlarge the cross-section of the turret and the latter would be limited by the necessity of preventing the pivoting tower from being impeded by the chassis' chain tread. In order in particular to ensure adequate space in the rear and behind the turret to accommodate the ammunition bunker described hereinafter on the other hand, the turret's wedge angle should not be too acute in order to allow for the requisite height along and at the rear of the turret. It turns out to be of advantage for the angles between the top of the turret and the horizontal and between the upper surface of the chassis and the horizontal to range between 3° and 7°.

It is preferable to mount the heavy weapon outside of the turret, on its upper surface. The ammunition is stowed in a bunker behind and secured to the turret and accordingly in bulkheaded-off and explosion-acceptable accommodations behind the particularly elevated frontal protection ensured by the chassis and the wedge-shaped turret. The bunker is not higher than the rear of the turret. Ammunition can be directly supplied to the weapon from the bunker by an automatic loading system as will be described hereinafter with reference to one embodiment.

The commander and gunner sit under the turret inside the chassis on a turntable that rotates with the turret. On the top of the turret and above these seats are hatchways with hatches and periscopes. The commander and gunner accordingly have a 360° view from either the open hatchway or through the periscope due to the wedge shape and situation of the turret.

It is also possible to position an emergency magazine for a prescribed number of shells just forward of the rear wall inside the turret. Since the weapon can be oriented with its end accessible from at least one of the hatchways, it can be loaded manually from the emergency magazine with the hatchway open in the event of breakdown or failure to ignite.

It is also possible in a military tank in accordance with the invention to provide a special entrance in the rear of the chassis and to exploit the space in the chassis behind the turret and below the bunker to carry grenadiers or wounded. It is accordingly possible to employ the military tank in accordance with the invention as an armored troop carrier.

One embodiment of the invention will now be specified with reference to the accompanying drawings.

DETAILED DESCRIPTION OF THE INVENTION

Figure 1:
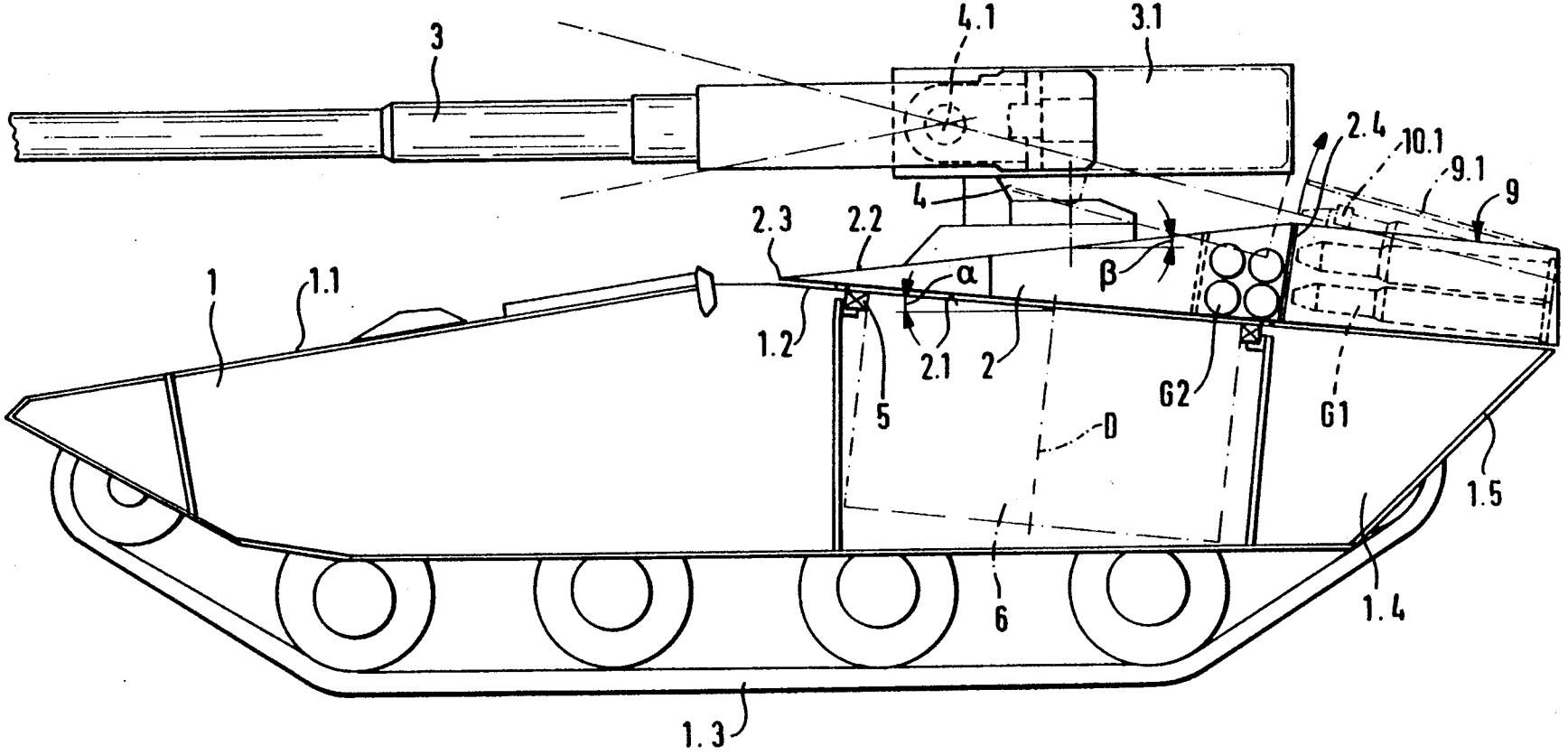
FIG. 1 is a schematic and partly sectional side view of a military tank according to the invention.
Figure 2:
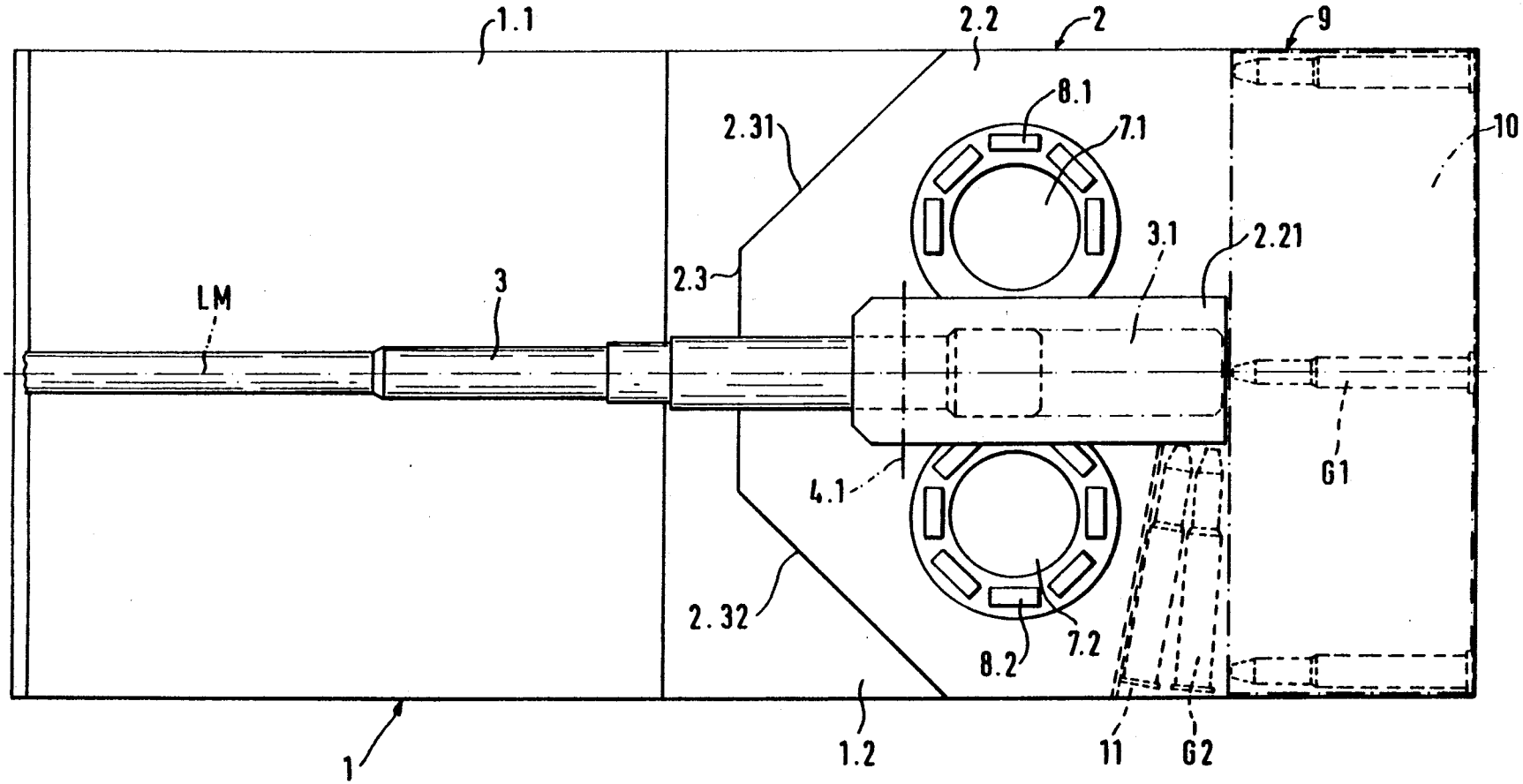
FIG. 2 is a top view of the tank illustrated in FIG. 1.
Figure 3:
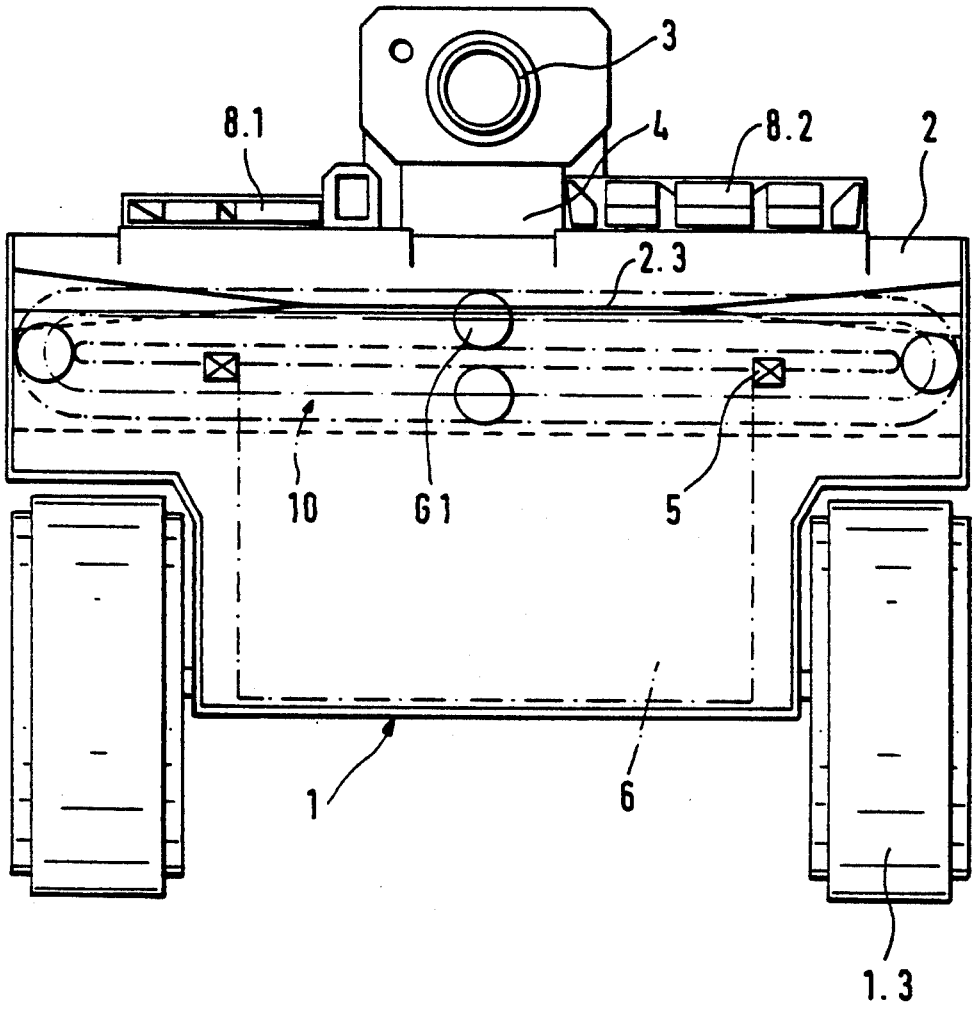
FIG. 3 is a front view of the same tank.

The military tank illustrated in FIGS. 1 through 3 has a chassis 1 with a chain tread 1.3. The front half 1.1 of the upper surface of the chassis slopes down forward, and the rear half 1.2 slopes down to the rear. The angle $\alpha$ between rear half 1.2 and the horizontal is approximately 6°. Rotating around an axis D on rear half 1.2 is a turret 2. The vertical longitudinal cross-section of the turret is a wedge that tapers from back to front. The bottom 2.1 of the turret parallels the rear half 1.2 of the chassis's upper surface. The top 2.2 of the turret slopes up at an angle $\beta$ to the horizontal of approximately 6°. The angle at the apex 2.3 of the turret is accordingly $\alpha+\beta\approx 12°$.

The angles can of course be different. The angle $\beta$ between the top 2.2 of the turret and the horizontal can for example be more acute. It is even possible for the top of the turret to be horizontal or slope down to the rear. In such an event of course angle o must be obtuse enough to ensure adequate space at the rear of the turret.

The turret revolves on a ring 5 in chassis 1. Positioned on the top 2.2 of the turret is a weapon mount 4.

A heavy weapon 3 pivots up and down on trunnions 4.1 on mount 4. Below turret 2 is a platform 6 that is rigidly attached to and rotates with it in chassis 1. On platform 6 are unillustrated seats for the commander and gunner. Above these seats and in the top 2.2 of the turret are hatchways 7.1 and 7.2 (FIG. 2) that can be closed off by hatches. Distributed around the hatchways are periscopes 8.1 and 8.2. Weapon mount 4 is positioned on the turret between hatchways 7.1 and 7.2 where weapon end 3.1 will be accessible from them. The top 2.2 of the turret also has a depression 2.21 in the vicinity of end 3.1 to accommodate it at higher elevations. The forward corners of turret 2 are beveled in a way that is in itself known such that the horizontal longitudinal cross-section of turret 2 is a trapezoid with sides 2.31 and 2.32 that taper together forward.

Fastened to the rear wall 2.4 of turret 2 and rotating with it around an axis D is an ammunition bunker 9 that accommodates a belt magazine 10. The magazine contains a stack of two layers of shells G1 circulating at a right angle to the turret and with their points toward the weapon. As will be evident from FIG. 2, the midpoint of magazine 10 is in the plane of elevation of weapon 3. Shells G1 are oriented in bunker 9 paralleling the bottom 2.1 of the turret at angle $\alpha$ to the horizontal.

To save even more space, the shells in magazine 10 can be tilted slightly forward with reference to the bottom 2.1 of the turret, and/or the upper layer of shells can be tilted slightly forward in relation to the lower layer. Neither situation is illustrated. The weapon can be loaded with an unillustrated automatic loader in alignment with the midpoint of magazine 10 and including an only sketchily illustrated shell holder 10.1 that lifts the shell beside its head. Attached to the automatic loader and rising along with shell holder 10.1 is a flap 9.1 that is usually inside the armor plate on the roof of bunker 9. The lifted shell will accordingly be extracted from the bunker tilted up and toward the weapon. Once weapon 3 has been positioned at a high elevation, it will be possible to align the shell with the axis of the weapon's barrel in shell holder 10.1. In this position the shell can be loaded by the automatic loader.

The walls of bunker 9 are provided in a not specifically illustrated way with weak points so that it will blow outward in the event the shells accommodated therein explode. The bunker can be constructed for example like that disclosed in German Patent 2 552 470.

Since the axis D or the turret's rotation is at angle $\alpha$ to the vertical, the weapon's elevations will vary as the turret rotates. This variation is compensated by computerized mechanisms that are in themselves known.

Inside turret 2 and immediately in front of rear wall 2.4 as will be evident from FIGS. 1 and 2, four more shells G2 are accommodated in an emergency-access magazine 11. These shells will be accessible in the event of a malfunction when it is impossible to reload the weapon from main magazine 10. Emergency-access magazine 11 and the rear end 3.1 of the weapon are accessible from hatchway 7.2, so that the weapon can be loaded by hand from emergency-access magazine 11 when the hatchway is open.

In the rear of the back 1.4 of chassis 1 is a door 1.5 that allows the crew to enter and exit.

As will be evident from FIG. 1, the space 1.4 in the rear of chassis 1 can be utilized for passengers, so that the tank can carry grenadiers or wounded.

What is claimed is:

1. A military tank comprising: a chassis having a front half and a rear half having an upper surface; a turret; means mounting the turret for rotation on the upper surface of the rear half of the chassis; a heavy weapon; means mounting the weapon for pivotable movement on the turret; wherein at least a section of the upper surface of the rear half of the chassis below the turret slopes back and down at a given angle $\alpha$ to the horizontal of 3° to 70°; wherein a vertical cross section of the turret is a wedge which tapers together towards the front half and with a bottom wall paralleling said section of the upper surface of the rear half of the chassis and a top wall disposed at a given angle $\beta$ to the horizontal of 3° to 7°; wherein the means mounting the weapon comprises a weapon mount on the top wall of the turret to suspend the weapon pointed forward and pivoting up and down; and wherein the turret has a rear wall and further comprising an ammunition bunker attached behind and to the rear wall of the turret above the chassis.

2. The tank as in claim 1, further comprising a belt magazine in the bunker and accommodating shells head forward, wherein one point of the magazine is in a plane of elevation of the weapon.

3. The tank as in claim 2, wherein the shells are stowed in the magazine paralleling the bottom wall of the turret.

4. The tank as in claim 2, further comprising a shell holder at least at the point of the magazine in the plane of elevation of the weapon for lifting the shell beside its head at a given angle into the position in alignment with the axis of the weapon's barrel at a given elevation.

5. The tank as in claim 1, further comprising a depression behind the weapon mount in the top wall of the turret to accommodate an end of the weapon at higher elevations.

6. The tank as in claim 1, further comprising a platform in the chassis below and fastened tot he turret and a hatchway above said platform and hatch in the top wall of the turret.

7. The tank as in claim 6, further comprising periscopes distributed around each hatchway in the top wall of the turret.

8. The tank as in claim 6, wherein the turret has a rear wall and further comprising an emergency-access magazine in the turret directly in front of the rear wall and accommodating a prescribed number of shells at a right angle to its length.

9. The tank as in claim 8, wherein the means mounting the weapon includes a weapon mount positioned between the hatchways wherein an end of the weapon is accessible from at least one of the hatchways.

10. The tank as in claim 1, wherein a horizontal longitudinal cross-section of the turret is a trapezoid that tapers forward.

11. The tank as in claim 1, further comprising a door in the rear half of the chassis.

* * * * *